US006514072B1

(12) United States Patent
Bencic

(10) Patent No.: US 6,514,072 B1
(45) Date of Patent: Feb. 4, 2003

(54) METHOD OF PROCESSING CARBON FIBERS

(75) Inventor: David M. Bencic, Batavia, NY (US)

(73) Assignee: Harper International Corp., Lancaster, NY (US)

( * ) Notice: Subject to any disclaimer, the term of this patent is extended or adjusted under 35 U.S.C. 154(b) by 0 days.

(21) Appl. No.: 09/862,928

(22) Filed: May 23, 2001

(51) Int. Cl.[7] ..... F27B 9/28
(52) U.S. Cl. ..... 432/8; 432/59
(58) Field of Search ..... 432/59, 8; 226/97.3

(56) References Cited

U.S. PATENT DOCUMENTS 3,810,735 A * 5/1974 Moser ..... 219/216
4,074,841 A * 2/1978 Kramer et al. ..... 226/97.3
5,791,455 A * 8/1998 Clopton ..... 198/779
5,915,958 A * 6/1999 Kurie ..... 219/388
5,967,770 A * 10/1999 Heine et al. ..... 432/59

* cited by examiner

*Primary Examiner*—Jiping Lu
(74) *Attorney, Agent, or Firm*—Jaeckle Fleischmann & Mugel, LLP

(57) ABSTRACT

This invention is for a novel method of treating carbon fiber. Carbon fiber is a very unique material and its processing requires high temperatures. Also since carbon fibers are lightweight and porous, heating is accomplished in this process by radiation with a heated gas flowing through the material. Also a float is used to transfer the material from one process station to another so as to prevent delaminating of the carbon fiber.

19 Claims, 1 Drawing Sheet

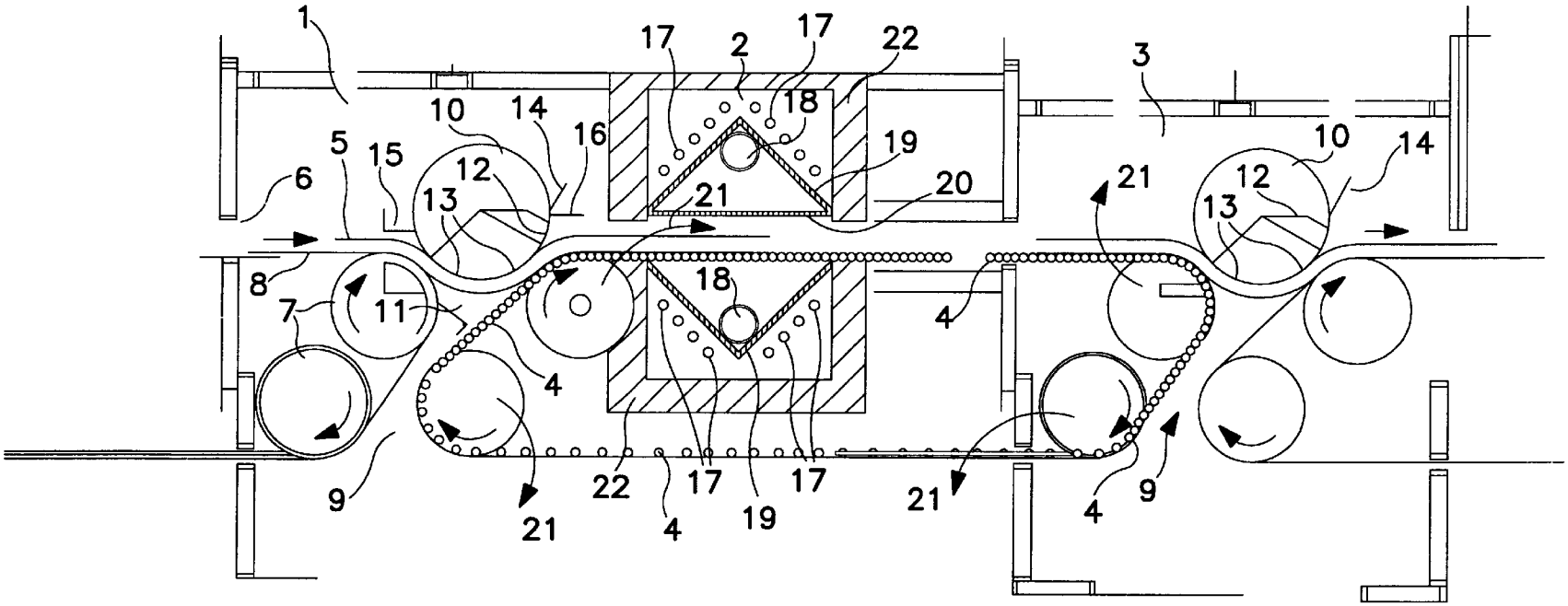
1
2
3
4
5
6
7
8
9
10
11
12
13
14
15
16
17
18
19
20
21
22

METHOD OF PROCESSING CARBON FIBERS

This invention relates to a method of processing non-rigid materials and more specifically, a method for processing carbon fiber material.

BACKGROUND OF THE INVENTION

Carbon fibers represent one of the most unique products having the strength of steel, the weight of aluminum and the conductivity of copper. These properties are extremely desirable for use today in building and construction, i.e., the automotive industry and in electronics and telecommunications products. They possess excellent thermal and electrical conductivity and because of their lightweight property, are ideal for the aircraft industry.

However, because of the relatively high cost of synthetic-based carbon fibers, their use has been limited. Only high priced goods such as aircraft, sporting goods and other expensive items could afford the use of carbon fibers. Other applications that require strength, stiffness, low weight and good fatigue characteristics had to use other less expensive and less effective products than carbon fiber. Because of these drawbacks or disadvantages, there is a real need for a carbon fiber that can economically compete with these cheaper and less effective materials. A process that will reduce production costs of carbon fibers and make them more universally available is very desirable. Any improved process to create stronger and lighter products of petroleum-based carbon fibers will also create new business and redefine how business is done in the carbon fiber industry. The present invention provides a method for processing carbon fibers that will meet these ends.

There are known processes for treating carbon fiber materials such as those described in U.S. Pat. Nos. 5,283,113 (Nishimura et al) and 5,967,770 (Heine et al). Other products not concerned with carbon fiber but directed to treatment of fibrous uses are 4,676,445; 4,504,344; 5,915,613; 5,979,731; 6,003,750; 6,004,432; and 6,050,469. Other patents directed to conveyor type processing of web materials are 4,718,543; 4,911,286; 5,791,455; and 5,848,890.

These above patents concerned with the unique product carbon fiber both disclose the basic process for producing carbon fiber felt which is the starting point for the process of the present invention. Nishimura discloses a process for continuously producing a pitch-based carbon fiber felt. His process starts with the raw materials and produces a pitch based carbon fiber felt having uniform unit weight and good physical properties. The Heine patent discloses a continuous treatment of carbon fibers in polyacrylonitrile which are heated and processed to produce a carbon fiber strand for use in the plastics arts.

The present process begins with a product similar to that of the Nishimura patent. Basically the present process takes a fiber mat of carbon pitch fibers and passes them on a conveyor into a section of the furnace that transfers it to the specialized sections to carbonize the fibers. This process will be further defined in reference to the accompanying drawings.

SUMMARY OF THE INVENTION

It is therefore an object of this invention to provide a process of treating carbon fiber mats devoid of the above noted disadvantages.

Another object of this invention is to provide a more efficient method of heating a fibrous carbon fiber mat.

Still a further object of this invention is to provide a process for treating carbon fiber mats that will allow for higher carbon fiber production and ultimate lower sale price.

Yet another object of this invention is to provide a very efficient and effective process for heating and transferring carbon fiber mats.

These and other objects of this invention are accomplished by a process for treating carbon-fiber mats that utilizes various treatment stations and effective transfer of the mat from one conveyor to another.

Processing of carbon fibers requires high temperatures that standard alloy conveyors may not be able to withstand. High temperature conveyors are costly and fragile. If such conveyors are made of carbon or graphite, they are subject to oxidation if not operated in an inert atmosphere. Portions of the process may require an oxidization atmosphere, which would not allow the use of carbon or graphite conveyors or components to transport the material. The high temperature conveyor could be used only in the required area, and other conveyors could be used before and after that area.

The material heating section may be a standard furnace. Since the carbon fiber material being processed is lightweight and porous, it acts as a thermal insulator and it may take significant time to heat through the entire material by radiation and conduction alone. This design shows heating by radiation with gas flows providing convection and driving the heat through the material. This would reduce the time required which would allow faster conveyor speed and/or a shorter heating section.

Heating elements heat the surface of the material by radiation. Gas flows through the hot surface and is heated, converting radiant heat to convection heat thus driving the heat deeper into the material at a faster rate.

As an option, radiation plates could be used to protect heating elements from the gas flow (which could erode heaters since heaters may run much hotter).

Another option is to add a porous plate above the material being processed to absorb the radiant heat and convert it to hot gas, which heats the material when passing through it.

Heaters may be provided below the conveyor to aid in heating the material in contact with the conveyor.

The transfer of lightweight fibrous material (such as carbon fibers) from one conveyor to another can be difficult if the material is fragile, very lightweight, composed of layers, or not able to bend sharply. This transfer section uses gas flow (air, nitrogen, etc) from a blower to "float" the material across the gap between conveyors. A drum or other moving conveyor above the gap allows the material to be blown or drawn up to the drum. The pressure under the material keeps the material from falling and delaminating as it crosses the gap.

The top drum could be a cylindrical perforated drum that rotates. Non-rotating ducts within the drum allow the suction to be in the area desired. Additional internal ducts could provide for "blow off" through the drum, which aids in removal of the material from the drum. This "blow off" also acts as a self-cleaning device to remove fibers sucked into the drum perforations.

The top drum could have the suction connection to the blower out the side of the drum, or the gas could flow through the drum surface into a mating duct.

The top drum could be replaced with a flat (or arched) conveyor belt. This would keep the material from bending if so desired. The flat conveyor could have internal ducts as described above. The top conveyor could be driven by conventional methods.

A perforated scraper could be added to scrape the material from the first conveyor if needed. This scraper would allow gas to flow through it to blow the material off the first conveyor and up to the drum. By positioning the scraper as shown, it will help guide the material to the inclined second conveyor if the gas flow should stop.

Exit purge boxes are used to allow control of gasses from one conveyor area to the other. For example, the first conveyor could have air as a gas while the second conveyor could have nitrogen as a gas. The exit purge box shown has provisions for a nitrogen purge pipe, which sprays nitrogen across the moving material. This could be on the entrance purge box also, if desired. The purge boxes have movable tops, which can be externally adjusted up or down to suite the height of the material. The boxes are designed to be remotely closed to compress the material and reduce gas flow from one conveyor to the other, or slammed down for safety reasons as needed.

Fibrous materials like carbon fiber and ceramic fiber mats have low strength and cannot tolerate abrasion. They must be placed on a conveyor to take them through furnaces for thermal processing.

In one embodiment of this invention, the large drum in the process of this invention has a non-rotating inner spool, which is hollow. The suction side of a blower is connected to this inner opening of the spool. The spool is secured from rotating by being locked in the wall. There are slots cut in the spool to allow gas to flow through holes in the drum hub and into the appropriate segments created by vanes. As the drum rotates, vane sections become "opened" and "closed" to the suction of the inner spool.

BRIEF DESCRIPTION OF THE DRAWING

The attached FIGURE is a diagrammatic view of the process according to the present invention.

DETAILED DESCRIPTION OF THE DRAWING AND PREFERRED EMBODIMENTS

In the FIGURE, a continuous process and apparatus is shown having three basic sections: an entrance transfer section 1, a carbonizing or graphitizing section 2, and exit transfer to cooling section 3. In section 1, a carbon fiber mat 5 is fed into the system via belt 8 at feed entrance 6. Belt 8 may be a conventional alloy mesh belt or other conveyor device. Rollers 7 drive conveyor belt 8 (which is supporting carbon fibers mat 5) forward in a direction toward section 2. Belt 8 could also be driven at the other end. The transfer of lightweight fibrous materials such as carbon fibers from one conveyor to another can be difficult if the material is fragile and not able to stay intact. Transfer section 1 uses gas flow from a blower 9 to float the material 5 across the gap between conveyors such as between conveyors 8 and 4. A drum 10 or other moving conveyor above the gap 11 allows the material to be blown or drawn up to the drum 10. The pressure under the mat or material 5 caused by the air flow from blower 9 keeps the material or mat 5 from falling and delaminating as it crosses gap 11. The top drum 10 could be a cylindrical perforated drum that rotates, having therein non-rotating ducts 12 to allow the suction to be in the area desired. Additional ducts 12 could be used to provide for blow-off through the drum 10 which also aids in the removal of the material (carbon fiber) from the drum. This blow off acts as a self-cleaning device to remove fibers sucked into the drum perforations 13. The top drum 10 could have the suction connection to the blower 9 outside the drum 10 or the gas could flow through the drum surface into a mating duct. The top drum 10 could be replaced with a flat or arched conveyor belt if desired. A scraper 14 may be used to remove excess carbon fibers. Adjacent to the top drum 10 are purge boxes, entrance purge box 15 and exit purge box 16. These boxes enclose the material 5 being transferred and allow control of gasses from one conveyor area to the other. For example, the conveyor 8 could have air as a gas while the second conveyor 4 could have nitrogen as a gas. The exit purge box 16 or entrance purge box 15 could have provisions for a nitrogen purge pipe. These purge boxes 15 and 16 may have movable tops which can be remotely adjusted up or down to suit the height of the material 5. Fibrous materials like carbon fiber mats 5 have low strength and cannot tolerate abrasion. They must be delicately transported by a conveyor through furnaces for thermal processing as in the system of the present invention.

If high temperatures are required, alloy conveyors are not suitable. Common refractory materials can withstand heat but are generally weak in tension and are brittle and high strength refractories are costly. High temperature materials could be used to support the fiber mats 5 while other materials could take the pull forces. The conveyor 4 used to transport the carbon-fiber mat is preferably made up of segmented or flexible side link-type chains with multiple cross pieces. The product or product carrier will be placed on the cross pieces. These cross pieces or conveyor 4 can be a variety of geometrys and can include rods, cylinders, wires, square bars, rectangular bars, square tubing, rectangular tubing or other appropriate shapes. The material of construction of the above-mentioned side links and cross pieces 4 and carriers can be metal, ceramic (including graphite), intermetallic, composite and/or other materials suitable for the furnace environment. "Intermetallics" are metals that exhibit ceramic-like properties. Examples of intermetallics are iron aluminide and molybdenum disilicide. "Composites" are materials made up of dissimilar materials. Examples of composites are silicon carbide reinforced aluminum and silicon carbide reinforced alumina. Alternatively, the conveyor 4 may be made up of plates, mesh, screen or a composite of forms. If the side chains are isolated from the heat, they could be alloy or other lower cost material. Cross members on conveyor 4 could be graphite, carbon-carbon, or other tubes, which are connected loosely to the driving chain. If gas flow is desired through the material being processed, the cross members could be spaced apart and/or have perforations in them. Several methods of attaching the cross members to the chain could be used. Various chain designs could be used also. In one embodiment of the present invention, standard link chain with attachments to support the cross members are used. Connections to the chain must be loose to allow for movement, misalignment, and expansion.

If the cross members are tubes on conveyor 4, the supporting surface will be smooth and provide a "funnel" area for gas flow, and the material could be "blown off" the conveyor at the end.

This concept is similar to the Harper International patent 5,848,890 for the same idea where cross members are supported and transported by blocks at the ends of the cross members. Many of the advantages listed on that patent would apply, such as uniformity, gas flow, and cost reductions, the disclosure of 5,848,890 is incorporated by reference in this present specification.

The mat 5 now goes to section 2 for heating. Since the carbon fiber 5 material being processed is lightweight and porous, it acts as a thermal insulator and it may take significant time to heat through the entire material by radiation or convection alone. The optional heat transfer porous plate 20 (above the fiber to be heated) is heated by radiation from the heating elements 17. As the gas flows through this from gas inlet tubes 18 through porous plates 20, the radiant heat is converted to convective (hot gas) heat, which then heats the fiber 5 being processed. This reduces the time required in the furnace and allows a faster drum speed and/or a shorter heating section. If porous plate 20 is omitted, radiant heat will heat the surface of the fiber 5 and the gas flow will drive the heat into the fiber. As an option, radiation plates 19 are shown which are used to protect the heating elements from the gas flow (which could erode heaters since heaters may run much hotter). Heaters are provided below the conveyor 4 to aid in heating the material in contact with the conveyor and to keep the conveyor from cooling. Heating elements 17 are surrounded by insulating sides 22 to prevent dissipation of heat.

From heating section 2 (carbonizing or graphitizing section) the carbon-fiber mat 5 is transported to the exit transfer cooling section 3. As in section 1, a top drum 10 having internal non-rotating ducts 12 is used. Drum perforations 13 suck material 5 up across gap 11 with the assistance of blower 9 which flows air up to the bottom face of mat 5. Rollers 21 move conveyor 4 throughout the illustrated process.

The carbon-fiber mat is now finally cooled in section 3 and ready to be taken out of the system for shipping, packing and use or may continue for further processing.

The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A process for treating and heating a porous carbon-fiber material which comprises the steps of: passing said material on a first supporting conveyor belt through a processing apparatus having at least two conveyor belts, transferring said material from said first material supporting conveyor belt to a second material supporting conveyor belt by providing a gas flow to a lower face of said material by a blower and a cylindrical roller with an internal low pressure non-rotating duct to provide thereby a gas pressure or support across a gap between said conveyor belts to thereby float the material across said gap, passing said material through a heating section in said apparatus whereby a heated gas is blown through said material to drive heat deeper into said material and thereby reducing the heating time required to carbonize said fiber material, subsequently cooling said fiber material and removing it from said process apparatus.

2. The process of claim 1 whereby said material supporting conveyor belt comprises a series of spaced movably connected members to form a driving chain, said members constructed of a member selected from the group consisting of graphite, carbon-carbon, ceramic, intermetallics, composites and mixtures thereof.

3. The process of claim 1 whereby said heat provided is selected from the group consisting of radiant heat, convection heat, gaseous heat and mixtures thereof.

4. The process of claim 1 whereby said gas is selected from the group consisting of nitrogen, air, inert gas, and mixtures thereof.

5. The process of claim 1 whereby a rotating drum is in contact with an upper face of said material.

6. The process of claim 1 whereby adjustable purge boxes are provided above said gap thereby isolating any gas from one said conveyor to another said conveyor.

7. The process of claim 1 whereby said apparatus has at least one said heating section, said heating section comprising a heating element above said material and a heating element below said material to provide thereby rapid heating of said carbon-fibers by radiant heat.

8. The process of claim 1 whereby at least said supporting conveyor belt is made up of spaced elements to provide thereby spaces for said gas to pass through en route to said lower surface of said material.

9. The process of claim 1 whereby said supporting conveyor is made up of spaced elements, said elements selected from the group consisting of graphite pipes, rods, plates, mesh, screen, cylinders, wires, bars, tubes and mixtures thereof.

10. A system for transporting, treating and heating a porous carbon-fiber material which comprises at least two separated conveyor belts having means to support said carbon-fiber material, a material supporting conveyor belt extending at least through and out of said heating section in said system, said material supporting conveyor belt made up of spaced movably connected components or members to form a driving chain conveyor, a second conveyor displaced from said material supporting conveyor by a gap, said system having a blower means to blow a gas to lower face of said material through said supporting conveyor to provide thereby means for floating said material across said gap, said heating section means having a means to blow a heated gas through said supporting conveyor and said material and means located after said heating section to cool said material.

11. The system of claim 10 whereby said material supporting conveyor belt comprises a series of spaced movably connected members to form a driving chain, said members constructed of a member selected from the group consisting of graphite, carbon-carbon, ceramic, intermetallics, composites and mixtures thereof.

12. The system of claim 10 whereby said heat provided is selected from the group consisting of radiant heat, convection heat, gaseous heat and mixtures thereof.

13. The system of claim 10 whereby said gas is selected from the group consisting of nitrogen, air, inert gas, and mixtures thereof.

14. The system of claim 10 whereby a rotating drum is in contact with an upper face of said material.

15. The system of claim 10 whereby adjustable purge boxes are provided adjacent to said gap thereby isolating any gas from one said conveyor to another said conveyor.

16. The system of claim 10 whereby said apparatus has at least one said heating section, said heating section comprising a heating element above said material and a heating element below said material to provide thereby rapid heating of said carbon-fibers by radiant heat.

17. The system of claim 10 whereby at least said supporting conveyor belt is made up of spaced elements to provide thereby spaces for said gas to pass through en route to said lower surface of said material.

18. The system of claim 10 whereby said supporting conveyor is made up of spaced elements, said elements selected from the group consisting of graphite pipes, rods, plates, mesh, screen, cylinders, wires, bars, tubes and mixtures thereof.

19. The system of claim 10 having means to heat said material by radiant heat and having means to subsequently flow a gas through said material to internally heat said material.

* * * * *